United States Patent [19]

Schneider

[11] 4,227,631

[45] Oct. 14, 1980

[54] VALVE FOR A SPRAY CONTAINER

[76] Inventor: Hilmar Schneider, Erlenweg 11, D-6201 Oberjosbach, Fed. Rep. of Germany

[21] Appl. No.: 953,921

[22] Filed: Oct. 23, 1978

[30] Foreign Application Priority Data

Oct. 29, 1977 [DE] Fed. Rep. of Germany ..... 2748736

[51] Int. Cl.[3] ..... B05B 7/32

[52] U.S. Cl. ..... 222/635; 222/402.18; 239/372

[58] Field of Search ..... 222/635, 402.18, 402.24, 222/4; 239/372, 369

[56] References Cited

U.S. PATENT DOCUMENTS

| | | | |
|---|---|---|---|
| 3,033,473 | 5/1962 | Kitabayashi | 239/372 X |
| 3,409,180 | 11/1968 | Schenk | 222/635 |
| 3,425,600 | 2/1969 | Abplanalp | 222/635 |
| 3,596,811 | 8/1971 | Gronemeger | 222/402.24 |

FOREIGN PATENT DOCUMENTS

| | | | |
|---|---|---|---|
| 964243 | 3/1975 | Canada | 222/402.24 |
| 2425149 | 11/1975 | Fed. Rep. of Germany | 222/635 |

*Primary Examiner*—Robert J. Spar
*Assistant Examiner*—Frederick R. Handren
*Attorney, Agent, or Firm*—W. G. Fasse; D. F. Gould

[57] ABSTRACT

The present valve for a spray container has a mixing chamber for mixing a gas propellant with the active ingredient for producing a finely atomized spray. The gas propellant enters into the valve housing by means of sufficient clearance between the walls of the valve body and the valve housing. The active ingredient and the gas propellant both enter into a mixing chamber through simultaneously openable and closable passage openings. The valve stem of the present valve has two channels. One channel in the valve stem provides a flow path for the gas propellant and for the active ingredient mixture, the other channel in the stem providing a flow path substantially for the gas propellant alone. These channels combine in a second mixing chamber resulting in still further atomization of the spray and a more efficient utilization of substantially the entire container content.

14 Claims, 3 Drawing Figures

VALVE FOR A SPRAY CONTAINER

BACKGROUND OF THE INVENTION

The invention relates to a valve for a spray container, in particular, for a pressurized-gas packaging. The valve has a valve body with a hollow valve stem. The free, upper end forming the stem of the valve body supports a spray head. Furthermore, the valve body is biased by a spring and is axially movable within a valve housing. Preferably, the biasing spring is located in said valve housing. The valve body with its stem extends through a sealing means in the cover or a facing wall of the container. The sealing meansor gasket is situated in a circumferential groove in the valve body and is deformable to allow passage through or to close a passage opening extending into the valve stem. The portion of the hollow valve body situated inside of the container is connected to a stand or riser pipe extending substantially to the bottom of the container.

A valve of this type is known, for example, from U.S. Pat. No. 3,596,811. The known valve is applied only in connection with an aerosol container. An aerosol packaging or aerosol spray container typically holds in its bottom portion a mixture of liquid-gas propellants, an active ingredient, and a solvent. The gas propellant is situated above these elements in the remaining free space of the container.

The German Patent Publication No. P 24 25 149 describes a valve for a spray container wherein a gas from the pressurized gas stage of the container contents enters into the valve housing and flows into a hollow valve stem together with the active ingredient. Said valve, however, does not provide sufficient pressurized gas flow to maximize the atomization of the active ingredient. Another disadvantage of the prior art is seen in that it does not have a high efficiency in emptying the container content.

OBJECTS OF THE INVENTION

In view of the foregoing it is the aim of the invention to achieve the following objects singly or in combination:

- to produce a valve for a pressurized container with a bottom to top arrangement of active ingredient solution, followed by a liquid-gas propellant stage, and a gas propellant stage filling the top space in the container;
- to provide that the inner space of the valve housing of the above valve serves as a choking chamber for the pressurized gas;
- to provide the valve with a separate passage opening leading from the pressurized-gas stage of the container to the inner space of the valve housing and into an additional mixing chamber, preferably in the spray head;
- to provide the valve with two simultaneously openable and closable passage means, one of which extends between a valve body and a valve housing whereas the other passage extends from the active ingredient stage of the container contents through a stand or riser pipe;
- to provide that the above two passage openings extend to an atomizing chamber wherein the active ingredient already mixed with propellant is further mixed with additional propellant;
- to provide a valve stem having a separating wall forming two flow paths, one for the active ingredient-gas propellant mixture and a second substantially for gas propellant;
- to provide the valve housing with ribs which serve to guide the movement of the valve body and also to enhance the deformability of the sealing means; and
- to optimize the emptying of the container while simultaneously assuring a fine atomization of the spray throughout the operation of the container.

SUMMARY OF THE INVENTION

The present valve has a valve body which is guided in a valve housing. The inner space of the valve housing serves as a choking chamber for the pressurized gas. The valve body extends through the bottom of the valve housing. The inner space of the valve housing is operatively connected to the space in the container which holds the pressurized gas. Such operative connection is provided by a sufficient clearance between the valve housing and the lower valve body portion. A first openable and closable flow path extends from the gas space in the container through said clearance and through the interior space of the valve housing to the interior of the valve stem. A second flow path through the interior of the stand or riser pipe and simultaneously openable or closable with the first flow path, empties into the first flow path in a manner similar to an aspirator or water jet pump. A further flow path also extending through said valve housing and through a ring passage around the valve stem in the open position of the valve, has access to a separate channel in the valve stem for improved atomizing in the spray head. The mixture of active ingredients and gas propellants in the area where both flow paths come together, has the effect that the active ingredient leaves the spray head very finely atomized and a spray effect occurs, which is comparable with a genuine aerosol packaging. That is to say, the active ingredient is broken up by the mixing of gas propellants and active ingredients and arrives on the surface to be sprayed in the most finely atomized form possible.

BRIEF FIGURE DESCRIPTION

In order that the invention may be clearly understood, it will now be described by way of example, with reference to the accompanying drawings, wherein.

Figure 1:
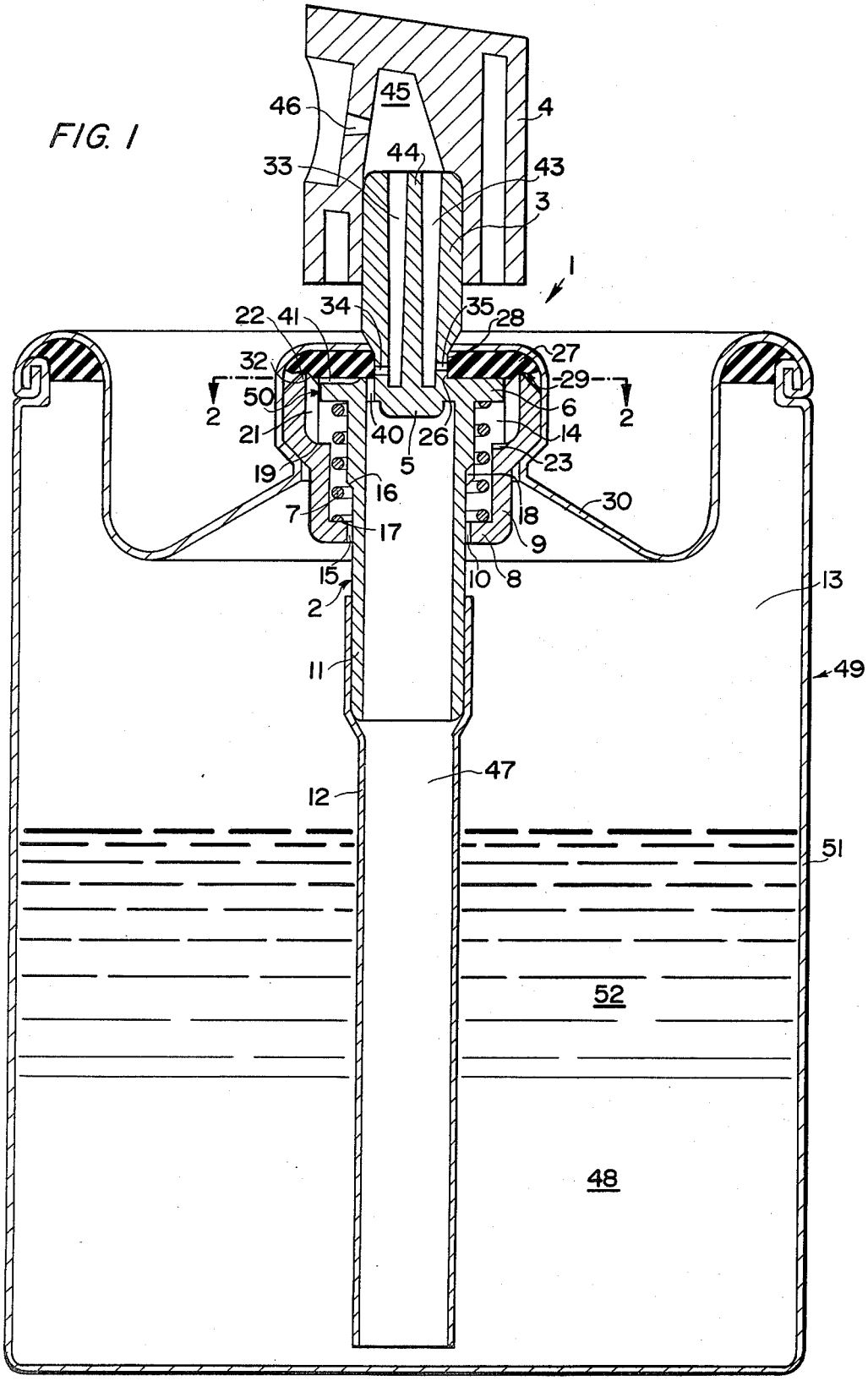
FIG. 1 illustrates a sectional view of a spray container and an oversized view of a valve according to the invention in the closed position of the valve.

DETAILED DESCRIPTION OF PREFERRED EXAMPLE EMBODIMENTS ILLUSTRATING THE BEST MODE FOR PRACTICING THE INVENTION

A valve 1 for a spray container 49 or a pressurized-gas packaging has a valve body 2 with a hollow valve stem 3. The contents of the container 49 are arranged from bottom to top as an active ingredient stage 48, a liquid gas propellant stage 52 and a gas-propellant stage 13. A spray head 4 is attached to the free, upper end of the valve stem 3. The valve body 2 is provided with an intermediate wall 5 and an outer flange 6 on the side of the valve stem 3 facing the inside of the spray container 49. A compression spring 7 rests against the intermediate wall 5 and is further supported at the bottom 8 of a valve housing 9. A passage opening 10 for a hollow valve member 11 is arranged in the bottom 8 of the valve housing 9 and provides a clearance between the hollow valve member 11 and the bottom 8. the hollow valve member 11 and the valve stem 3 are preferably integrally connected forming a single piece. A stand or riser pipe 12 extending into the active ingredient stage 48 in the container is connected to the hollow valve member 11.

The passage opening 10 or clearance 15 is so dimensioned that there is a sufficient play between the edge 17 of the valve housing bottom and the wall of the hollow valve member 11 for the pressurized gas to pass from the upper stage 13 of the spray container into the inner space 14 of the valve housing 9. The inner space 14 of the valve housing 9 serves as a choking or throttling chamber. The ring gap or clearance 15 formed by the play between the edge of the passage opening 10 and the valve member 11 serves as a choking or throttling gap.

Figure 3:
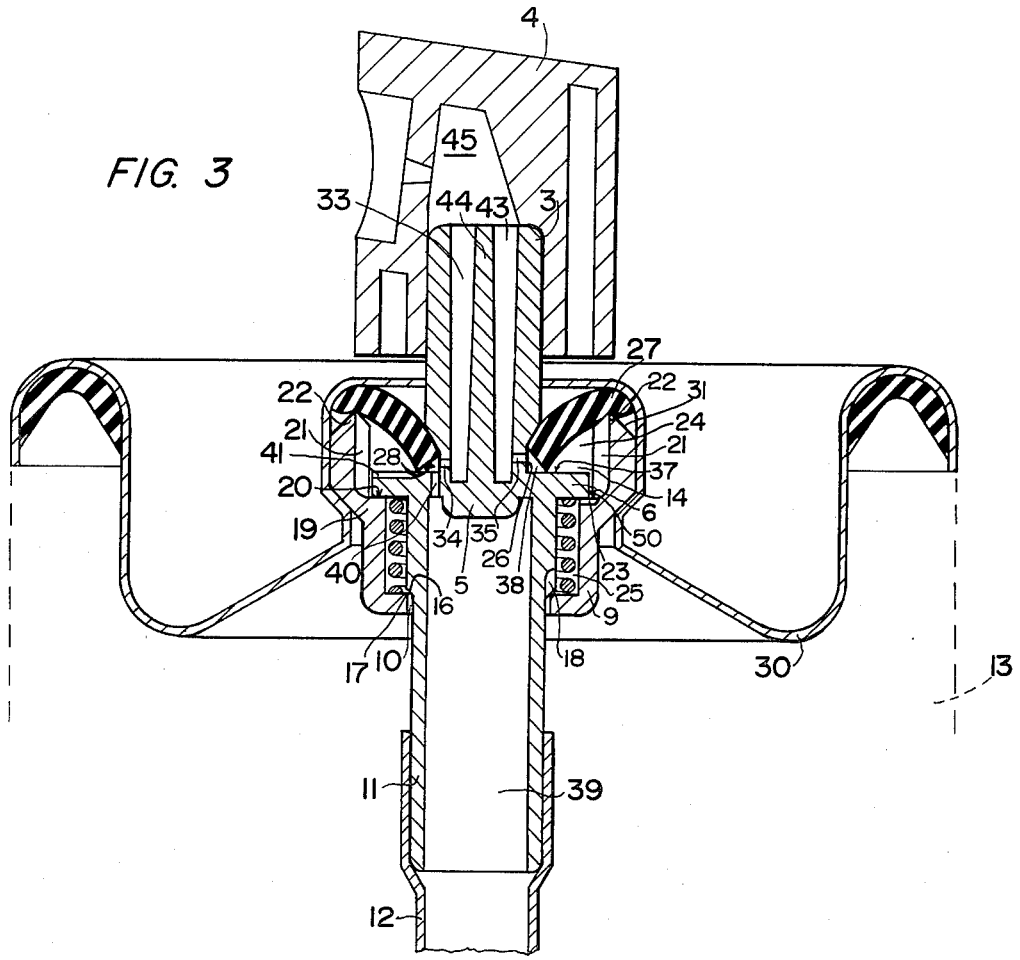
FIG. 3 illustrates a sectional view of the valve of FIG. 1 in the open position.

The exterior side of the valve member 11 has, in addition, a conical shoulder 16 which widens from bottom to top. The conical shoulder 16 rests on an edge 17 of the passage opening 10 when the valve is open, as seen in FIG. 3. However, pressurized gas still flows from the gas stage 13 of the container interior to the inner space 14 of the valve housing 9 due to the fact that at least one axially extending outflow groove 18 is arranged in the area of the conical shoulder 16. The number and dimension of the outflow grooves 18 is chosen, so that the inner space 14 of the valve housing 9 has the desired pressure.

In addition, the valve housing 9 has an annular shoulder 19. The edge 20 of the outer flange 6 rests on the annular shoulder 19 when the valve is open according to FIG. 3.

A plurality of ribs 21 extend in an axial direction from the annular shoulder 19 to the free edge 22 of the valve housing 9. These ribs 21 cooperate with the edge 50 of the outer flange 6 in guiding the valve body 2 in the valve housing 9. Similarly, the passage opening 10 cooperating with the hollow valve member 11 provides some guidance of the valve body 2 whithin the valve housing 9 so that the member 11 cannot tilt beyond the clearance 15.

The annular shoulder 19 also has at least one, preferably several, radially extending outflow groove means 23. The outflow groove 23 provides a flow path between the upper portion 24 of the inner space 14 having the larger diameter and the lower portion 25 having the smaller diameter when the valve is open, namely, when the outer flange 6 rests on the annular shoulder 19 as shown in FIG. 3. The number and dimensions of the outflow grooves 23 is chosen, so that the desired pressure is present in the upper portion 24 of the inner space 14 of the valve housing 9 when the valve is open.

The valve body 2 has a circumferential groove 26 directly next to the outer flange 6 or the intermediate wall 5. The inner edge 28 of a sealing ring 27 is located in the circumferential groove 24 when the valve is closed in FIG. 1. The outer edge 29 of the sealing ring 27 is pinched between the free edge 22 of the valve housing 9 and covering member 30 of the container 49. The covering element 30 which is connected to the walls 51 of the container 49 by conventional means such as crimping, has a shape matched to the outer contour of the valve housing 9 so as to substantially enclose the valve housing 9 in a form locking manner, whereby the sealing ring 27 is securedly held in position.

The free edge 22 of the valve housing 9 which securely holds the sealing ring 27 has at least one annular beveled surface 31 (FIG. 3) sloping downwardly and outwardly. Thus, the sealing ring 27 rests on the free edge 22 along a line, which enhances a firm seating of the sealing ring 27 and which influences the deformability of the sealing ring 27 in a favorable manner. FIGS. 1 and 3 show that this effect may be increased if the ends of the ribs 21 have beveled surfaces 32 which slop downward and inwardly in the area of the edge 22 of the valve housing 9.

At least one passage opening 34 extends from the hollow inner space or channel 33 of the valve stem 3 to the circumferential groove 26. The end of the passage opening 34 is blocked by the inner edge 28 of the sealing ring 27 when the valve is closed as shown in FIG. 1. The passage 34 is open when the valve is open as shown in FIG. 3. An annular mixing chamber 38 (FIG. 3) for the active ingredient and the propellant such as pressurized gas, is formed between the bottom of the circumferential groove 26 and the inner edge 28 of the sealing ring 27 and the facing surface 37 of the outer flange 6 when the valve is being opened as shown in FIG. 3. The annular chamber 38 is connected with the inner space or channel 33 of the valve stem 3 as soon as the inner edge 28 of the sealing ring 27 unblocks the passage openings 34 due to the deforming of the sealing ring 27. A further passage 35 preferably also leads from the annular chamber 38 into the hollow stem 3, and preferably into a separate chamber 43 in the stem 3 as will be described in more detail below.

At least one passage opening 40 coming directly from the hollow inner space 39 of the valve member 11 ends directly upstream of the passage opening 34 in the area of the annular chamber 38 and downstream of a groove 41 through which propellant is supplied whereby a jet pump action is accomplished as will also be described in more detail below.

At least one groove 41 is situated in the facing surface 37 of the outer flange 6. The groove 41 is blocked by the sealing ring 27 when the valve is closed as in FIG. 1 whereby the pressurized propellant is prevented from passing through the groove 41 into channel 33 of the stem 3. When the valve is open as in FIG. 3 the groove 41 communicates with the passage 34 in the immediate vicinity of the passge opening 40 in the annular mixing chamber 38 formed by the deforming of the sealing ring 27.

The groove 41 forms a second closable or openable flow path extending from the inner space 14 of the valve housing 9 into the inner space or channel 33 of the valve stem 3. The passage 40 forms a third closable or openable flow path and merges into the annular mixing chamber 38 directly adjacent to the second flow path 41 and intermediate the first passage 34 and the second path 41 whereby an aspirator or water jet pump action is achieved. The interior or the inner space of the valve stem 3 is connected to the annular mixing chamber 38 by means of the passage openings 34, 35 of which the latter opening 35 forms a fourth passage.

Figure 2:
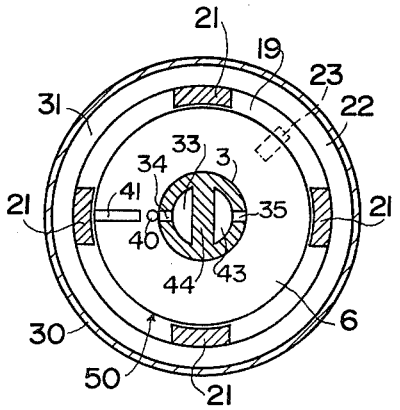
FIG. 2 illustrates a section of the valve in FIG. 1 along the section line 2—2.

Preferably, the inner space of the valve stem is separated into two longitudinal channels 33 and 43 by a wall 44, see also FIG. 2. The passage openings 34 and 35 are circumferentially spaced from each other, and preferably open into different longitudinal channels 33, 43. In addition, the openings 34, 35 are axially staggered relative to each other. The passage opening 35, in particular, is preferably positioned as far removed as possible from the passage opening 40 so that, when the valve is open, practically no active ingredient but rather primarily pure pressurized gas propellant flows into the longitudinal canal 43 whereby this additional propellant enhances the vaporization and intense distribution of the active ingredient by the propellant in a collection chamber 45 in the spray head 4. However, a substantial quantity of active ingredient and pressurized gas flowing through the groove 41 enter into the passage opening 34 situated directly adjacent to the passage opening 40. The active ingredient and the pressurized-gas flow together through the longitudinal channel 33 into the spray head 4. These media combine with the pressurized gas flowing through the longitudinal channel 43, in said collection chamber 45 of the spray head 4. The spray then leaves the spray head 4 through the opening 46. It has been found that the additional supply of propellant through the passage 35 and the channel 43 increases the efficiency of removing substantially all of the active ingredient from the can 49 before the propellant is exhausted. A more intense mixing and vaporization also results.

The inner space 39 of the lower valve member 11 is a cylindrical, longitudinal channel extending directly into the interior 47 of the attached riser pipe 12 which in turn extends into the active ingredient stage 48 of the container 49.

Furthermore, it is possible to vary the size of the passage openings 34, 35 and, in particular, to assure that the passage opening 35 extending into the second longitudinal channel 43 of the valve stem 3 has a smaller cross section than the passage opening 34 extending into the first longitudinal channel 33.

Although the invention has been described with reference to specific example embodiments, it is to be understood that it is intended to cover all modifications and equivalents within the scope of the appended claims.

What is claimed is:

1. In a spray container valve including valve housing means (9), valve body means (2) axially movable within said valve housing means, hollow stem means (3) operatively connected to said valve body means, spray head means (4) operatively connected to said hollow stem means, spring means (17) within said valve housing means and operatively connected to said valve body means (2) for biasing the valve body means into a closed position, sealing means (27), hollow valve member means (11) operatively connected to said valve body means (2) opposite said hollow stem means (3), said hollow stem means extending through said sealing means, outer circumferential groove means (26) in said hollow stem means forming a seat for said sealing means, first passage means (34) into said hollow stem means, said first passage means being openable and closable by said sealing means, the improvement comprising a bottom opening (10) in said valve housing means, said hollow valve member means extending through said bottom opening with clearance (15), guide means (21) in said valve housing means, chamber means (14) defined by said valve housing means (9) and by said valve body means (2) to form a throttling chamber means, said clearance (15) and chamber means (14) permitting propellant to flow through the valve housing, second passage means (41) openable and closable by said sealing means and extending from said chamber means toward said first passage means, third passage means (40) extending from within said hollow valve member means (11) for cooperation with said second passage means (41) in the manner of a jet pump whereby active ingredient is drawn through said third passage means (40) for mixing with propellant coming through said second passage means (41) and whereby the active ingredient propellant mixture flows through said first passage means (34) into said hollow valve stem, said valve body means comprising intermediate wall means (5) including flange means (6) forming an integral structure with said hollow stem means (3) and with said hollow valve member means (11), said hollow stem means (3) comprising first and second (33, 43) longitudinal channels, said outer circumferential groove (26) in said hollow stem means being substantially adjacent said intermediate wall means, said first passage means (34) extending through said circumferential groove into one of said longitudinal channels, said valve further comprising fourth passage means (35) also extending through said circumferential groove but remote from said first passage means (34), whereby additional propellant is supplied into the other longitudinal channel of said hollow valve stem means.

2. The valve of claim 1, wherein said valve housing comprises seat means (19) for seating said flange means (6) of said intermediate wall means (5).

3. The valve of claim 1, wherein said sealing means comprise a deformable inner edge (28) for simultaneously closing or opening said first (34), second (41), third (40) and fourth (35) passage means.

4. The valve of claim 1, wherein second passage mean (41) are arranged on said flange means (6) facing said sealing means (27), said second passage means opening directly adjacent to said third passage means.

5. The valve of claim 1, wherein said guide means comprise ribs operatively connected to said valve housing means, said valve housing means including seat means (19) for said flange means (6), said ribs (21) extending substantially from said seat means (19) to said sealing means (27) whereby said ribs guide the axial movement of said valve body means.

6. The valve of claim 5, wherein said seat means (19) comprises groove means (23) extending into said chamber means (14).

7. The valve of claim 1, wherein said third passage means (40) opening directly adjacent said first passage means (34).

8. The valve of claim 1, wherein said valve housing means (9) comprises edge means (22) for supporting said sealing means (27).

9. The valve of claim 8, wherein said edge means are conical and beveled to slope down and radially outwardly.

10. The valve of claim 5, wherein said ribs have beveled surfaces (32) facing said sealing means (27), said beveled surfaces sloping down and radially inwardly.

11. The valve of claim 1, wherein said valve member means (11) comprises shoulder means (16) substantially adjacent said opening (10) in the valve housing means (9), said shoulder means comprising groove means (18) whereby flow of propellant into said throttle chamber means (14) is possible even when said shoulder means (16) rests against said opening (10) in the valve housing means (9).

12. The valve of claim 1, wherein said first (34) and fourth (35) passage means are circumferentially spaced from each other in said circumferential groove (26) on substantially opposite sides of said hollow valve stem, said first and fourth passage means being axially displaced relative to each other.

13. The valve of claim 1, further comprising mixing chamber means (38) formed by the deforming of said sealing means (27) in said circumferential groove means whereby said active ingredient and propellant are mixed in said mixing chamber means (38).

14. The valve of claim 1, wherein said first passage means (34) has a smaller cross sectional passage area than said fourth passage means (35).

* * * * *